US011371246B2

(12) United States Patent
Ekker

(10) Patent No.: US 11,371,246 B2
(45) Date of Patent: Jun. 28, 2022

(54) AUTOMATIC DOWNSPOUT ASSEMBLY

(71) Applicant: Jon Ekker, Franklin, TN (US)

(72) Inventor: Jon Ekker, Franklin, TN (US)

( * ) Notice: Subject to any disclaimer, the term of this patent is extended or adjusted under 35 U.S.C. 154(b) by 238 days.

(21) Appl. No.: 16/861,966

(22) Filed: Apr. 29, 2020

(65) Prior Publication Data

US 2021/0340769 A1 Nov. 4, 2021

(51) Int. Cl.
*E04D 13/08* (2006.01)

(52) U.S. Cl.
CPC ..... *E04D 13/08* (2013.01); *E04D 2013/0806* (2013.01); *E04D 2013/0846* (2013.01); *E04D 2013/0873* (2013.01)

(58) Field of Classification Search
CPC ..... E04D 13/08; E04D 2013/0806; E04D 2013/0813; E04D 2013/0846; E04D 2013/0873
See application file for complete search history.

(56) References Cited

U.S. PATENT DOCUMENTS 4,135,540 A 1/1979 Felsen
5,482,084 A * 1/1996 Cassidy ..... E04D 13/08 137/120
5,522,427 A * 6/1996 Johnson ..... E04D 13/08 137/616.5
5,673,519 A * 10/1997 McCaughan ..... E04D 13/08 52/16
5,735,085 A 4/1998 Denooy
6,240,680 B1 6/2001 Estes
6,827,103 B2 12/2004 Cheremshynski
2006/0016129 A1* 1/2006 Riese ..... E04D 13/08 52/16
2011/0239547 A1 10/2011 Port
2016/0194879 A1 7/2016 Gleason
2017/0081857 A1* 3/2017 Ellis ..... E04D 13/08

* cited by examiner

*Primary Examiner* — Kevin F Murphy

(57) ABSTRACT

An automatic downspout assembly includes an intake pipe that is fluidly coupled to a downspout of a gutter on a building to receive precipitation from the downspout. A spout is rotatably coupled to and extends laterally away from the intake pipe and the spout is in fluid communication with the intake pipe to receive the precipitation. A stand is positionable beneath the intake pipe when the intake pipe is fluidly coupled to the downspout to support the intake pipe above a support surface. A tipping pipe is fluidly coupled to the spout to receive precipitation from the spout. The tipping pipe is biased into a home position and the tipping pipe can be urged into a tipped position when the tipping pipe fills with precipitation. In this way the tipping pipe directs the precipitation onto ground.

11 Claims, 8 Drawing Sheets

AUTOMATIC DOWNSPOUT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to downspout devices and more particularly pertains to a new downspout device for automatically rotating a downspout into an upright position.

(2) Description of Related Art Including Information Disclosed Under 37 CFR 1.97 and 1.98

The prior art relates to downspout devices. The prior art discloses an automatically tipping downspout that rotatably engages a gutter and which is manually positionable between an upright position and a downward position. The prior art discloses a downspout that includes a horizontal section that is hingedly coupled to a vertical section. The prior art also discloses an automatic downspout that is biased into an upright position with spring tension and which is urged into a downward position by weight of an entrained column of water.

BRIEF SUMMARY OF THE INVENTION

An embodiment of the disclosure meets the needs presented above by generally comprising an intake pipe that is fluidly coupled to a downspout of a gutter on a building to receive precipitation from the downspout. A spout is rotatably coupled to and extends laterally away from the intake pipe and the spout is in fluid communication with the intake pipe to receive the precipitation. A stand is positionable beneath the intake pipe when the intake pipe is fluidly coupled to the downspout to support the intake pipe above a support surface. A tipping pipe is fluidly coupled to the spout to receive precipitation from the spout. The tipping pipe is biased into a home position and the tipping pipe can be urged into a tipped position when the tipping pipe fills with precipitation. In this way the tipping pipe directs the precipitation onto ground.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
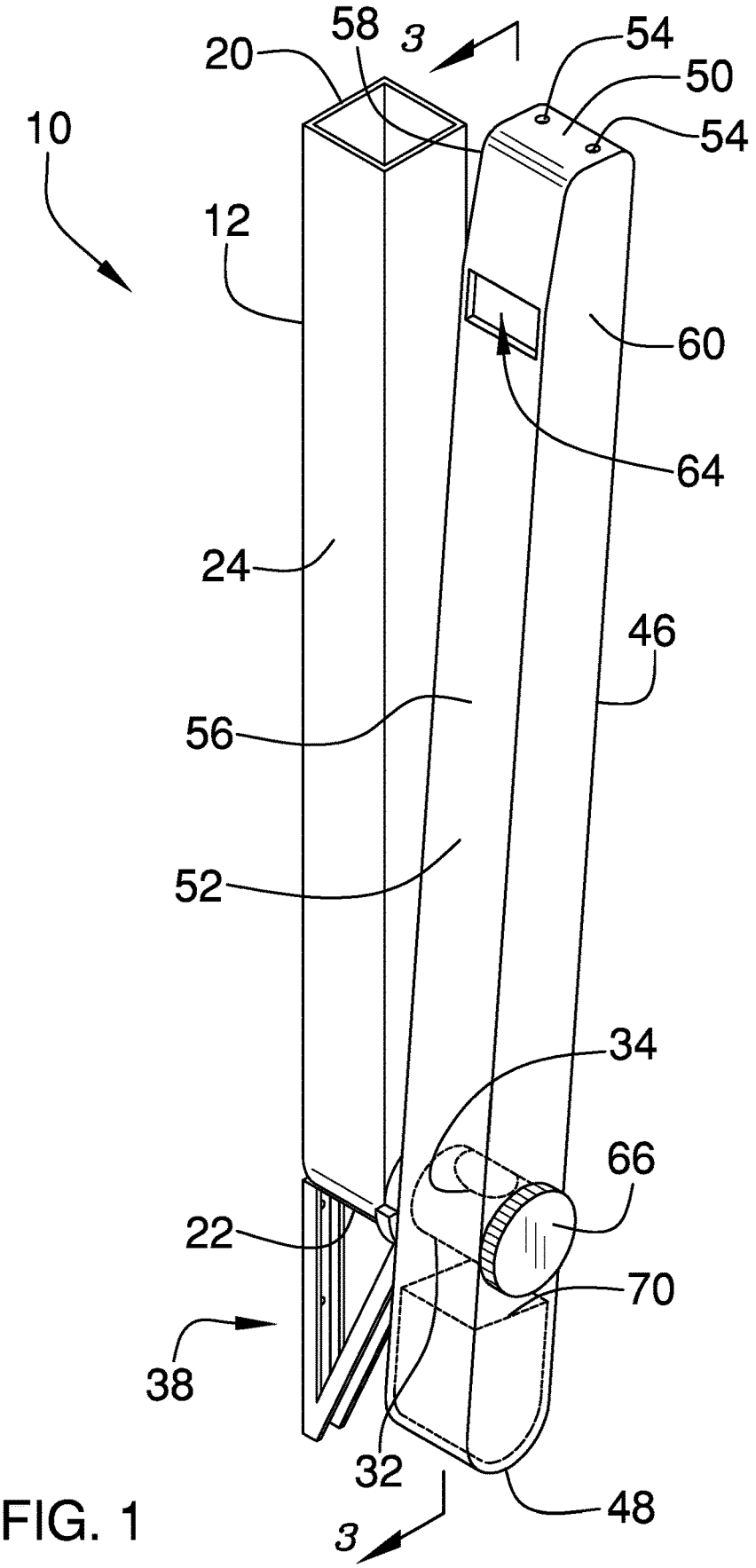
FIG. 1 is a perspective view of an automatic downspout assembly according to an embodiment of the disclosure.
Figure 2:
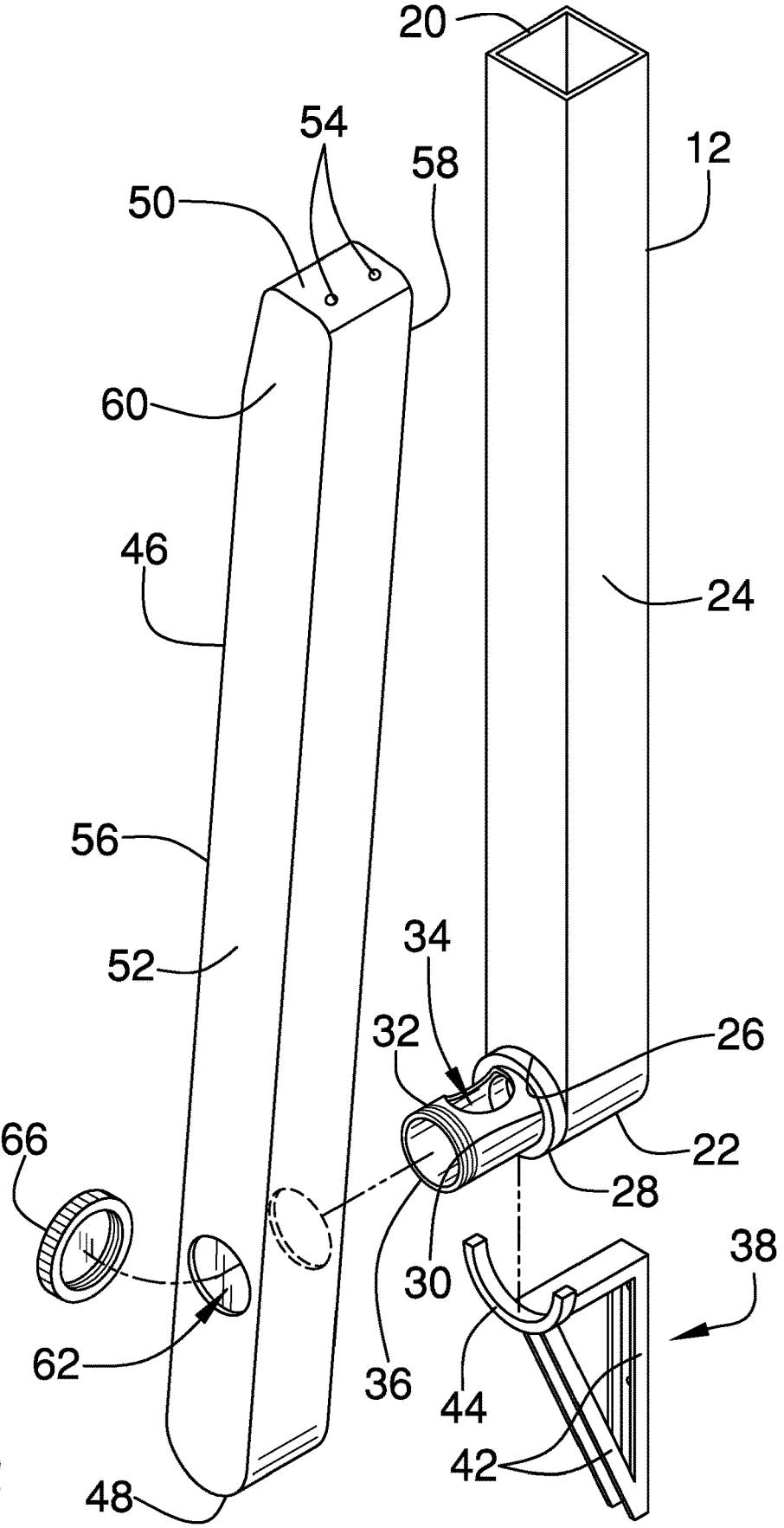
FIG. 2 is an exploded perspective view of an embodiment of the disclosure.
Figure 3:
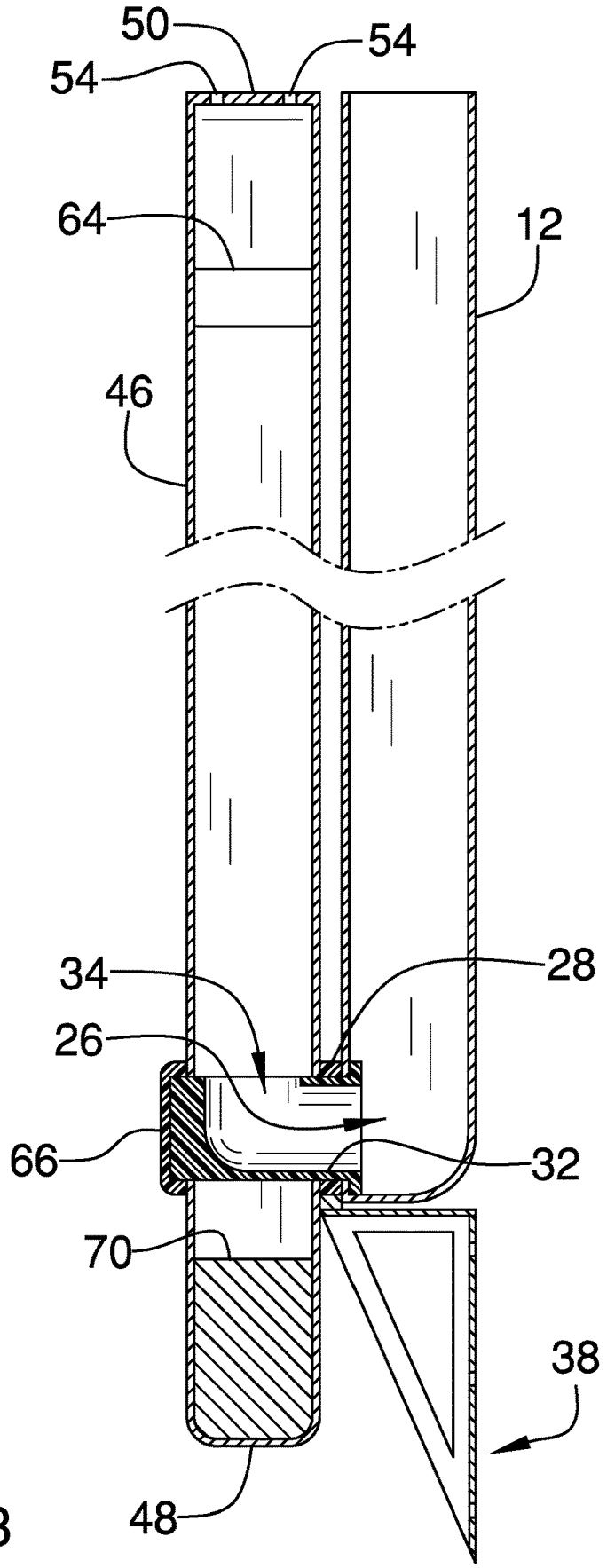
FIG. 3 is a cross sectional view taken along line 3-3 of FIG. 1 of an embodiment of the disclosure.
Figure 4:
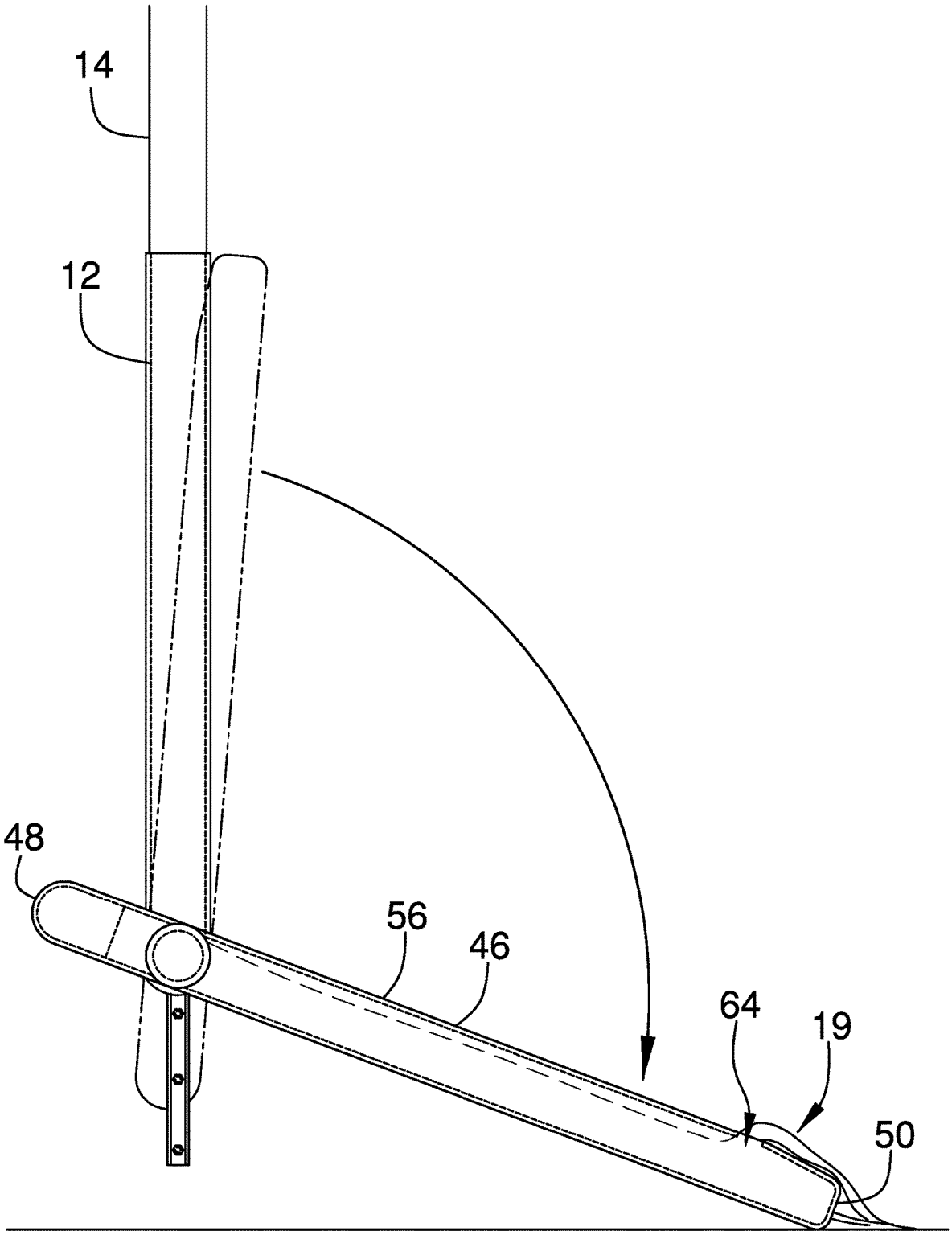
FIG. 4 is a perspective view of an embodiment of the disclosure showing a tipping pipe in a tipped position.
Figure 5:
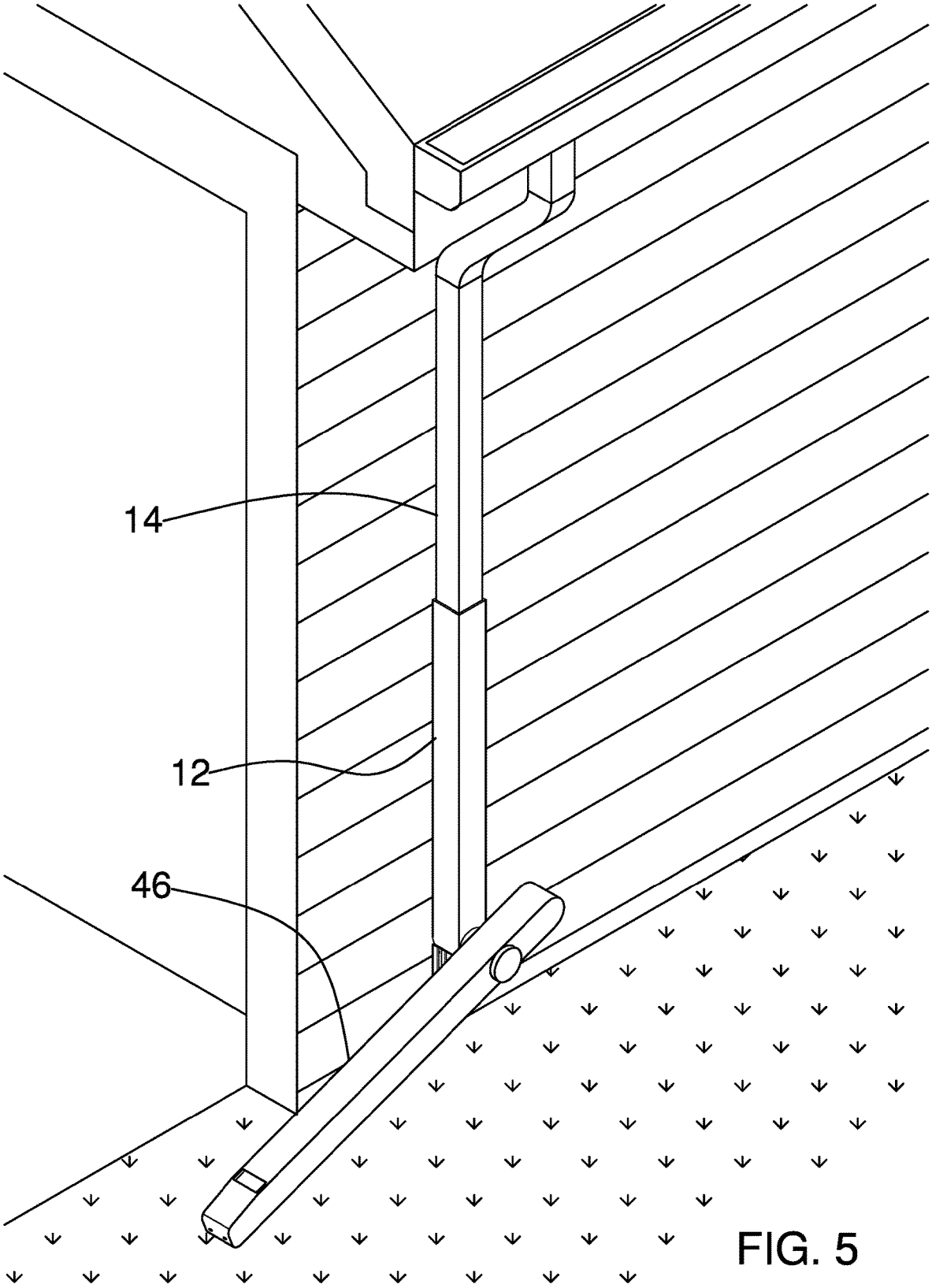
FIG. 5 is a perspective in-use view of an embodiment of the disclosure showing a tipping pipe in a tipped position.
Figure 6:
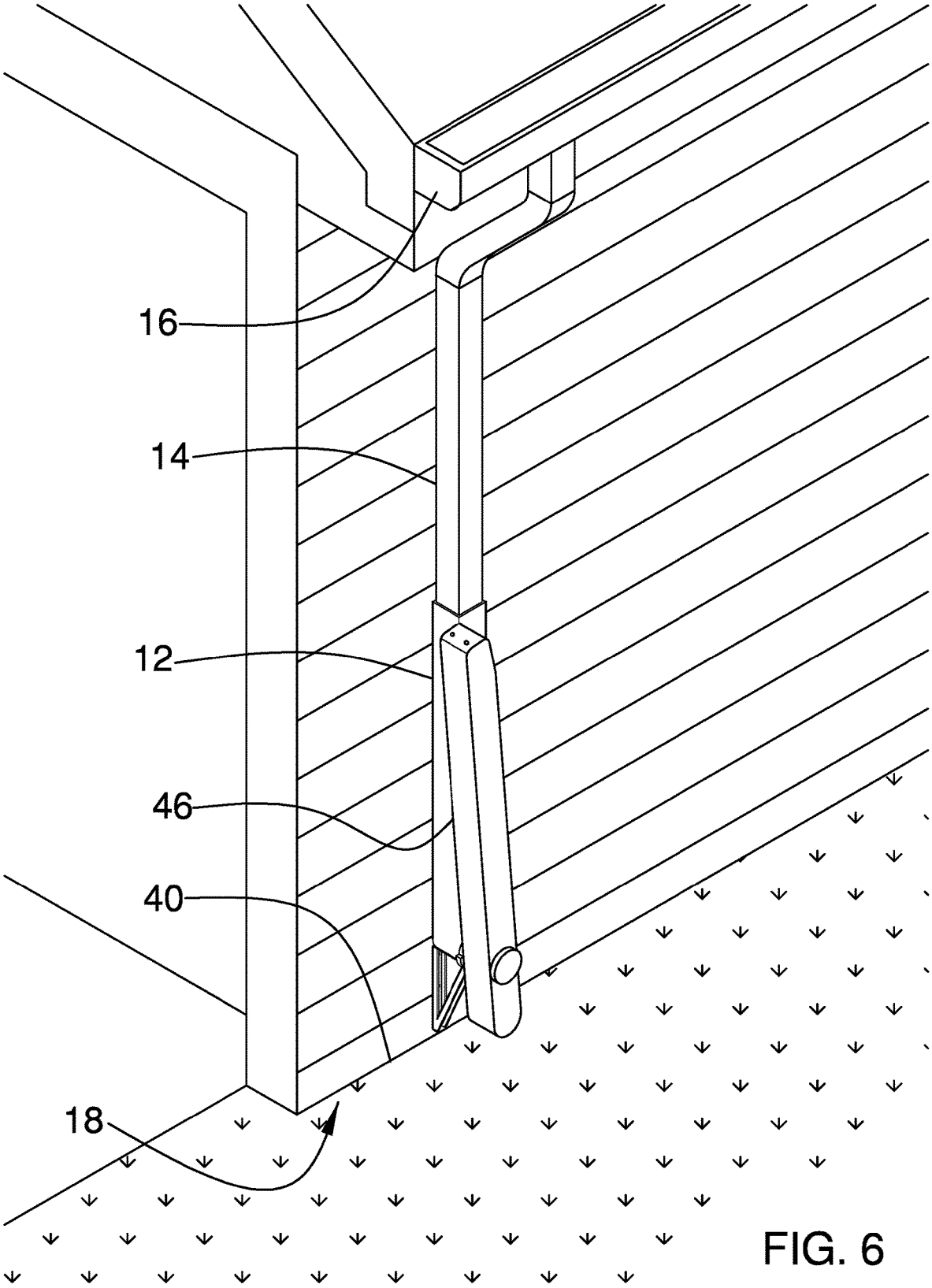
FIG. 6 is a perspective in-use view of an embodiment of the disclosure showing a tipping pipe in a home position.

With reference now to the drawings, and in particular to FIGS. 1 through 10 thereof, a new downspout device embodying the principles and concepts of an embodiment of the disclosure and generally designated by the reference numeral 10 will be described.

As best illustrated in FIGS. 1 through 10, the automatic downspout assembly 10 generally comprises an intake pipe 12 is fluidly coupled to a downspout 14 of a gutter 16 on a building 18 to receive precipitation 19 from the downspout 14. The building 18 may be a house, an apartment building, a commercial building, or any other building that employs a gutter system. The intake pipe 12 has an upper end 20, a lower end 22 and an outer wall 24 extending therebetween, and the upper end 20 is open into an interior of the intake pipe 12 for insertably receiving the downspout 14. The lower end 22 is closed and the lower end 22 is convexly arcuate with respect to the upper end 20. The outer wall 24 has a fluid opening 26 extending into the interior of the intake pipe 12 and the fluid opening 26 is positioned adjacent to the lower end 22.

A bearing 28 is provided and the bearing 28 is coupled to the outer wall 24. The bearing 28 is aligned with the fluid opening 26 and the bearing 28 has a rotatable portion 30 with respect to the intake pipe 12. The bearing 28 may comprise a friction reducing bearing, such as a ring bearing or the like. Additionally, the bearing 28 may be fluid impermeable to inhibit fluid from escaping through the bearing 28.

A spout 32 is rotatably coupled to and extends laterally away from the intake pipe 12. The spout 32 is in fluid communication with the intake pipe 12 wherein the spout 32 is configured to receive the precipitation 19. The spout 32 has an outlet 34 therein for passing the precipitation 19 outwardly therethrough and the spout 32 is positioned on the rotatable portion of the bearing 28. The spout 32 is rotatable about a perpendicular axis with respect to an axis extending through the upper end 20 and the lower end 22 of the intake pipe 12.

The spout 32 is aligned with the fluid opening 26 to receive the precipitation 19. Additionally, the outlet 34 is directed toward the upper end 20 of the intake pipe 12 when the spout 32 is rotated into a home position. The outlet 34 is directed downwardly when the spout 32 is rotated into a downspout position. Moreover, the spout 32 has a distal end 36 with respect to the intake pipe 12 and the spout 32 is threaded adjacent to the distal end 36.

A stand 38 is positionable beneath the intake pipe 12 when the intake pipe 12 is fluidly coupled to the downspout 14 to support the intake pipe 12 above a support surface 40, such as an exterior wall of the building 18. The stand 38 includes a plurality of legs 42 and a saddle 44, and each of the legs 42 extends downwardly from the saddle 44. The saddle 44 is concavely arcuate such that the saddle 44 conforms to curvature of the lower end 22 of the intake pipe 12 and each of the legs 42 is coupled to the support surface with fasteners or the like. As is most clearly shown in FIGS. 2 and 3, the bearing 28 may rest on the saddle 44.

A tipping pipe 46 is provided and the tipping pipe 46 is fluidly coupled to the spout 32 to receive precipitation 19 from the spout 32. The tipping pipe 46 is biased into a home position having the tipping pipe 46 extending upwardly along the intake pipe 12. In this way the tipping pipe 46 is protected from being damaged by lawn care machinery or the like. Conversely, the tipping pipe 46 is urged into a tipped position when the tipping pipe 46 fills with precipitation 19. In this wherein the tipping pipe 46 directs the precipitation 19 onto ground in the convention of a traditional downspout 14.

The tipping pipe 46 has a rear end 48, a forward end 50 and an outer wall 52 extending therebetween. The forward end 50 has a pair of apertures 54 each extending into an interior of the tipping pipe 46 to release the precipitation 19 when the tipping pipe 46 is in the tipped position. The outer wall 52 of the tipping pipe 46 has a top side 56, a first lateral side 58 and a second lateral side 60, and the outer wall 24 has a spout opening 62 extending through the first lateral side 58 and the second lateral side 60. The spout opening 62 is positioned closer to the rear end 48 than the forward end 50 and the spout opening 62 insertably receives the spout 32. In this way the outlet 34 in the spout 32 is positioned within the tipping pipe 46 and the distal end 36 is exposed.

The outer wall 52 of the tipping pipe 46 has an overflow opening 64 extending into the interior of the tipping pipe 46 to release the precipitation 19 when the tipping pipe 46 is in the tipped position. The overflow opening 64 is positioned adjacent to the forward end 50 of the tipping pipe 46. Moreover, the overflow opening 64 is positioned on the top side 56 of the outer wall 52 of the tipping pipe 46. The overflow opening 64 facilitates the precipitation 19 to pour outwardly when the apertures 54 cannot handle to volume of precipitation 19.

A cap 66 is provided and the cap 66 is positionable around the distal end 36 of the spout 32. The cap 66 has an inwardly facing surface 68 that threadably engages threads on the spout 32 when the spout 32 is extended through the spout opening 62 in the tipping pipe 46. In this way the tipping pipe 46 is retained on the spout 32. A counterweight 70 is positioned within the tipping pipe 46 and the counterweight 70 is positioned against the rear end 48 of the tipping pipe 46. The counterweight 70 biases the tipping pipe 46 into the home position when no precipitation 19 is in the tipping pipe 46. The counterweight 70 has a weight that is less than the weight of approximately 25% of the internal volume of the tipping pipe 46 in water. In this way the counterweight 70 is overcome by the weight of precipitation 19 in the tipping pipe 46 when the tipping pipe 46 is more than approximately one quarter full.

Figure 7:
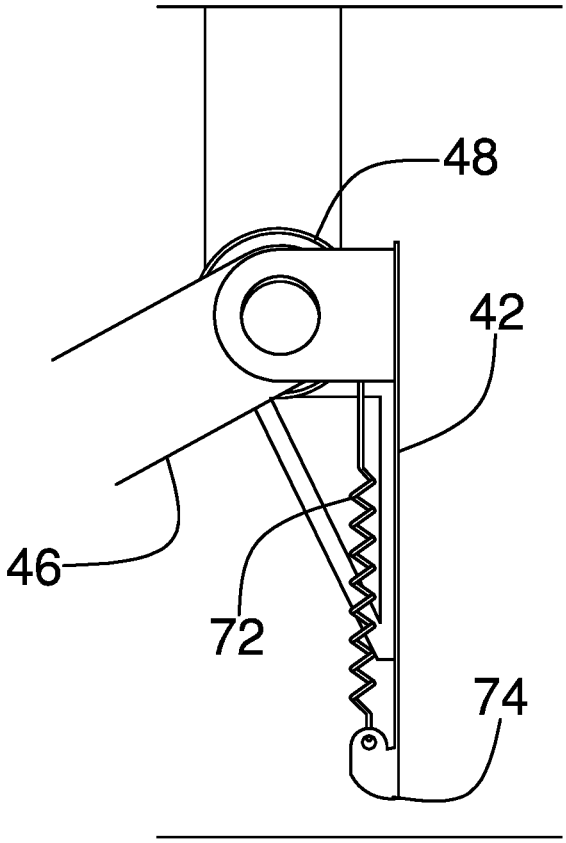
FIG. 7 is a right side view of an embodiment of the disclosure showing a biasing member being stretched while a tipping pipe is in a tipped position.
Figure 8:
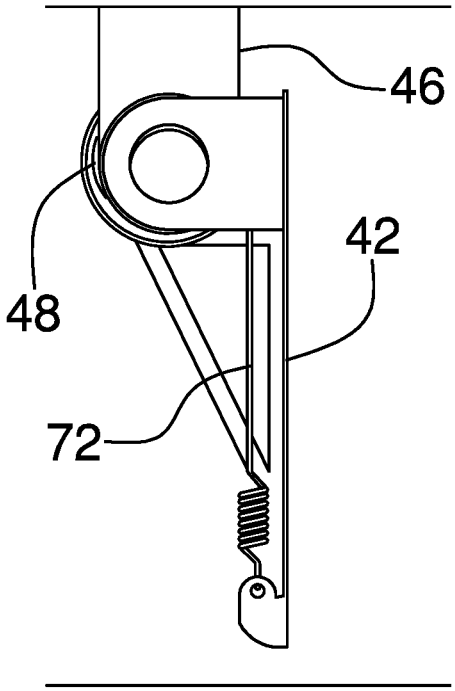
FIG. 8 is a right side view of an embodiment of the disclosure showing a biasing member biasing a tipping pipe into a home position.

As is most clearly shown in FIGS. 7 and 8, a biasing member 72 may be attached between the rear end 48 of the tipping pipe 46 and a bottom end 74 of the legs 42 of the stand 38. The biasing member 72 biases the tipping pipe 46 into the home position. Moreover, the biasing member 72 has a tensile strength that is sufficiently low to be overcome by the weight of precipitation 19 collecting in the tipping pipe 46. In this way the tipping pipe 46 will fall into the tipped position until the tipping pipe 46 is emptied, at which time the biasing member 72 will bias the tipping pipe 46 back into the home position.

Figure 9:
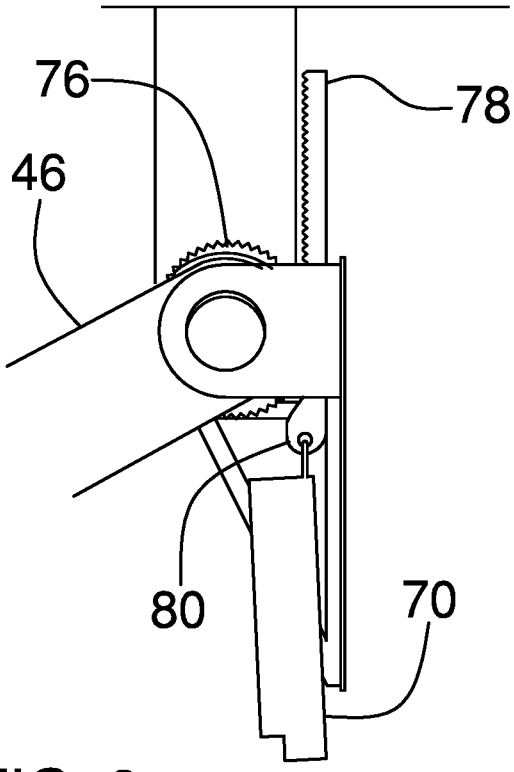
FIG. 9 is a right side view of an embodiment of the disclosure showing a ring gear and a rack gear for biasing a tipping pipe into a tipped position.
Figure 10:
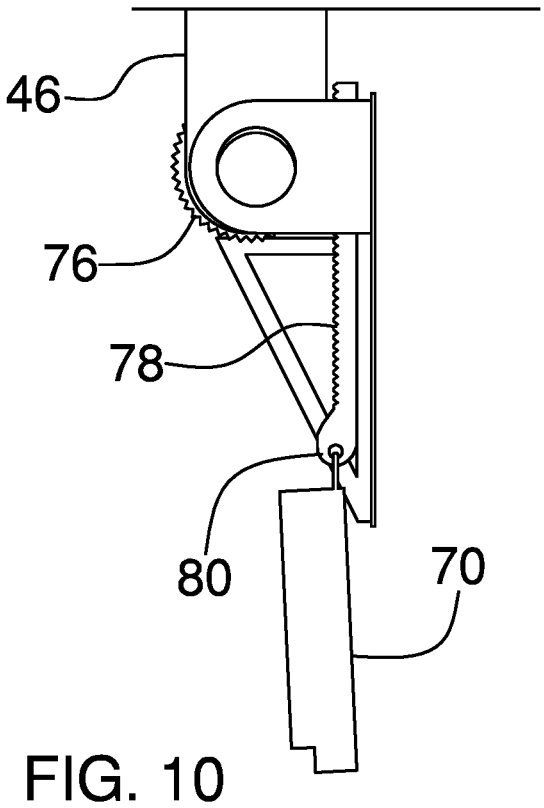
FIG. 10 is a right side view of an embodiment of the disclosure showing a ring gear and a rack gear for biasing a tipping pipe into a home position.

As is most clearly shown in FIGS. 9 and 10, a ring gear 76 may be coupled to the first lateral side 58 of the outer wall 52 of the tipping pipe 46 and the ring gear 76 may surround the spout 32. A rack gear 78 may be slidably coupled to the stand 38, the rack gear 78 may be vertically oriented on the stand 38 and the rack gear 78 may be slidable upwardly and downwardly on the stand 38. The counterweight 70 may be suspended from a lower end 80 of the rack gear 78 thereby biasing the rack gear 78 to travel downwardly on the stand 38. The ring gear 76 engages the rack gear 78 such that the ring gear 76 is rotated to urge the tipping pipe 46 into the home position when the rack gear 78 travels downwardly on the stand 38. The weight of the precipitation 19 that collects in the tipping pipe 46 will eventually overcome the weight of the counterweight 70, and the tipping pipe 46 will rotate into the tipping position having the rack gear 78 sliding upwardly on the stand 38.

In use, the intake pipe 12 is positioned on the downspout 14 and the stand 38 is positioned beneath the intake pipe 12. The tipping pipe 46 is biased into the home position when no precipitation 19 is being moved through the downspout 14. In this way the tipping pipe 46 is protected from being damaged by lawn care machinery or the like. The tipping pipe 46 begins to fill with precipitation 19 when the precipitation 19 moves through the downspout 14. Moreover, the tipping pipe 46 falls into the tipped position once the tipping becomes sufficiently filled with precipitation 19. Thus, the tipping pipe 46 angles downwardly toward the ground for directing the precipitation 19 onto the ground. The tipping pipe 46 returns to the home position when the tipping pipe 46 is sufficiently emptied of the precipitation 19.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic downspout assembly for automatically deploying or retracting, said assembly comprising:

an intake pipe being fluidly coupled to a downspout of a gutter on a building wherein said intake pipe is configured to receive precipitation from the downspout;

a spout being rotatably coupled to and extending laterally away from said intake pipe, said spout being in fluid communication with said intake pipe wherein said spout is configured to receive the precipitation, said spout having an outlet therein for passing the precipitation outwardly therethrough;

a stand being positionable beneath said intake pipe when said intake pipe is fluidly coupled to the downspout wherein said stand is configured to support said intake pipe above a support surface;

a tipping pipe being fluidly coupled to said spout wherein said tipping pipe is configured to receive precipitation from said spout, said tipping pipe being biased into a home position having said tipping pipe extending upwardly along said intake pipe, said tipping pipe being urged into a tipped position when said tipping pipe fills with precipitation wherein said tipping pipe is configured to direct the precipitation onto ground; and wherein said intake pipe has an upper end, a lower end and an outer wall extending therebetween, said upper end being open into an interior of said intake pine for insertably receiving the downspout, said lower end being closed, said lower end being convexly arcuate with respect to said upper end, said outer wall having a fluid opening extending into said interior of said intake pine, said fluid opening being positioned adjacent to said lower end.

2. The assembly according to claim 1, further comprising a bearing being coupled to said outer wall, said bearing being aligned with said fluid opening, said bearing having a rotatable portion with respect to said intake pipe.

3. The assembly according to claim 2, wherein said spout is positioned on said rotatable portion of said bearing.

4. The assembly according to claim 1, wherein said spout is rotatable about a perpendicular axis with respect to an axis extending through said upper end and said lower end of said intake pipe, said spout being aligned with said fluid opening wherein said spout is configured to receive the precipitation, said outlet being directed toward said upper end of said intake pipe when said spout is rotated into a home position, said outlet being directed downwardly when said spout is rotated into a downspout position, said spout having a distal end with respect to said intake pipe, said spout being threaded adjacent to said distal end.

5. The assembly according to claim 1, wherein said stand includes a plurality of legs and a saddle, each of said legs extending downwardly from said saddle, said saddle being concavely arcuate such that said saddle conforms to curvature of said lower end of said intake pipe, each of said legs extending between said saddle and the support surface.

6. The assembly according to claim 1, wherein said tipping pipe has a rear end, a forward end and an outer wall extending therebetween, said forward end having a pair of apertures each extending into an interior of said tipping pipe wherein said apertures are configured to release the precipitation when said tipping pipe is in said tipped position.

7. The assembly according to claim 6, wherein said outer wall of said tipping pipe has an overflow opening extending into said interior of said tipping pipe wherein said overflow opening is configured to release the precipitation when said tipping pipe is in said tipped position, said overflow opening being positioned adjacent to said front forward end of said tipping pipe said overflow opening being positioned on a top side of said outer wall.

8. The assembly according to claim 1, further comprising:

a bearing being coupled to said outer wall, said bearing being aligned with said fluid opening, said bearing having a rotatable portion with respect to said intake pipe;

said spout being positioned on said rotatable portion of said bearing, said spout being rotatable about a perpendicular axis with respect to an axis extending through said upper end and said lower end of said intake pipe, said spout being aligned with said fluid opening wherein said spout is configured to receive the precipitation, said outlet being directed toward said upper end of said intake pipe when said spout is rotated into a home position, said outlet being directed downwardly when said spout is rotated into a downspout position, said spout having a distal end with respect to said intake pipe, said spout being threaded adjacent to said distal end;

said stand including a plurality of legs and a saddle, each of said legs extending downwardly from said saddle, said saddle being concavely arcuate such that said saddle conforms to curvature of said lower end of said intake pipe, each of said legs extending between said saddle and the support surface;

said tipping pipe having a rear end, a forward end and an outer wall extending therebetween, said forward end having a pair of apertures each extending into an interior of said tipping pipe wherein said apertures are configured to release the precipitation when said tipping pipe is in said tipped position, said outer wall having a top side, a first lateral side and a second lateral side, said outer wall having a spout opening extending through said first lateral side and said second lateral side, said spout opening being positioned closer to said rear end than said forward end, said spout opening insertably receiving said spout such that said outlet in said spout is positioned within said tipping pipe and said distal end exposed, said outer wall having an overflow opening extending into said interior of said tipping pipe wherein said overflow opening is configured to release the precipitation when said tipping pipe is in said tipped position, said overflow opening being positioned adjacent to said forward end of said tipping pipe, said overflow opening being positioned on said top side of said outer wall;

a cap being positionable around said distal end of said spout, said cap having an inwardly facing surface that threadably engages threads on said spout when said spout is extended through said spout opening in said tipping pipe for retaining said tipping pipe on said spout; and a counterweight being positioned within said tipping pipe, said counterweight being positioned against said rear end of said tipping pipe, said counterweight biasing said tipping pipe into said home position when no precipitation is in said tipping pipe, said counterweight having a weight being less than the weight of approximately 25.0% of the internal volume of said tipping pipe in water wherein said counterweight is configured to be overcome by the weight of precipitation in said tipping pipe when said tipping pipe is more than approximately one quarter full.

9. An automatic downspout assembly for automatically deploying or retracting, said assembly comprising:

an intake pipe being fluidly coupled to a downspout of a gutter on a building wherein said intake pipe is configured to receive precipitation from the downspout;

a spout being rotatably coupled to and extending laterally away from said intake pipe, said spout being in fluid communication with said intake pipe wherein said spout is configured to receive the precipitation, said snout having an outlet therein for passing the precipitation outwardly therethrough;

a stand being positionable beneath said intake pipe when said intake pipe is fluidly coupled to the downspout wherein said stand is configured to support said intake pipe above a support surface;

a tipping pipe being fluidly coupled to said spout wherein said tipping nine is configured to receive precipitation from said spout, said tipping pipe being biased into a home position having said tipping nine extending upwardly along said intake pipe, said tipping pipe being urged into a tipped position when said tipping pipe fills with precipitation wherein said tipping pipe is configured to direct the precipitation onto ground;

wherein said tipping pipe has a rear end, a forward end and an outer wall extending therebetween, said forward end having a pair of apertures each extending into an interior of said tipping pipe wherein said apertures are configured to release the precipitation when said tipping pipe is in said tipped position; and wherein said outer wall has a top side, a first lateral side and a second lateral side, said outer wall having a spout opening extending through said first lateral side and said second lateral side, said spout opening being positioned closer to said rear end than said forward end, said spout opening insertably receiving said spout such that said outlet in said spout is positioned within said tipping pipe and a distal end of said spout relative to said intake pipe is exposed.

10. An automatic downspout assembly for automatically deploying or retracting, said assembly comprising:

an intake pipe being fluidly coupled to a downspout of a gutter on a building wherein said intake pipe is configured to receive precipitation from the downspout;

a spout being rotatably coupled to and extending laterally away from said intake pipe, said spout being in fluid communication with said intake pipe wherein said spout is configured to receive the precipitation, said spout having an outlet therein for passing the precipitation outwardly therethrough;

a stand being positionable beneath said intake pipe when said intake pipe is fluidly coupled to the downspout wherein said stand is configured to support said intake pipe above a support surface;

a tipping pipe being fluidly coupled to said spout wherein said tipping pipe is configured to receive precipitation from said spout, said tipping pipe being biased into a home position having said tipping pipe extending upwardly along said intake pipe, said tipping pipe being urged into a tipped position when said tipping pipe fills with precipitation wherein said tipping pipe is configured to direct the precipitation onto ground;

wherein said tipping pipe has a rear end, a forward end and an outer wall extending therebetween, said forward end having a pair of apertures each extending into an interior of said tipping pipe wherein said apertures are configured to release the precipitation when said tipping pipe is in said tipped position; and a counterweight being positioned within said tipping pipe, said counterweight being positioned against said rear end of said tipping pipe, said counterweight biasing said tipping pipe into said home position when no precipitation is in said tipping pipe.

11. The assembly according to claim 10, wherein said counterweight has a weight being less than the weight of approximately 25.0% of the internal volume of said tipping pipe in water wherein said counterweight is configured to be overcome by the weight of precipitation in said tipping pipe when said tipping pipe is more than approximately one quarter full.

* * * * *